US005378084A

United States Patent [19]

Walters et al.

[11] Patent Number: 5,378,084

[45] Date of Patent: Jan. 3, 1995

[54] BACKPACK SYSTEMS

[76] Inventors: William D. Walters, 2230 Biscay Ct., Byron, Calif. 94514; Jay G. Stone, 29943 Harvester Rd., Malibu, Calif. 90265; Steve D. Walters, 2230 Biscay Ct., Byron, Calif. 94514

[21] Appl. No.: 217,776

[22] Filed: Mar. 24, 1994

Related U.S. Application Data

[63] Continuation of Ser. No. 800,442, Nov. 18, 1991, abandoned.

[51] Int. Cl.[6] ..... B63C 11/08

[52] U.S. Cl. ..... 405/186; 441/106

[58] Field of Search ..... 405/185, 186, 187; 224/153, 209, 215; 441/88, 106, 108, 114, 115, 119

[56] References Cited

U.S. PATENT DOCUMENTS

| | | |
|---|---|---|
| 684,835 | 10/1901 | Littell . |
| 3,014,448 | 4/1959 | Fogarty et al. . |
| 3,436,777 | 6/1967 | Greenwood . |
| 3,891,131 | 6/1975 | Tabata . |
| 4,009,583 | 3/1977 | Buckle . |
| 4,016,616 | 4/1977 | Walters . |
| 4,054,132 | 10/1977 | Deeds . |
| 4,137,585 | 2/1979 | Wright, III . |
| 4,561,853 | 12/1985 | Faulconer et al. . |
| 4,694,772 | 9/1987 | Faulconer et al. . |
| 4,779,554 | 10/1988 | Courtney . |
| 4,810,134 | 3/1989 | Eaulconer et al. . |
| 4,952,095 | 8/1990 | Walters . |
| 5,046,894 | 9/1991 | Bergstrom ..... 405/186 |

FOREIGN PATENT DOCUMENTS 2197627A 10/1987 United Kingdom .

*Primary Examiner*—David H. Corbin

[57] ABSTRACT

A scuba pack is disclosed that enables a user to carry a substantial back supported load with comfort and mobility. The pack has a flexible load container having a base panel for engagement on the back of a user, wherein the base panel having extensions fitting over each shoulder and around a portion of the waist of the user. The pack also has a harness disposed on the front of the user, which adjustably interconnects the extensions of the flexible load container across the front waist of the user. The harness also adjustably interconnects the shoulder extensions to the waist extensions. The harness is longitudinally flexible within a selected range, such that load forces are transmitted to the waist region while holding the load in conformity to the user without restricting body movement.

13 Claims, 5 Drawing Sheets

FIG. 4
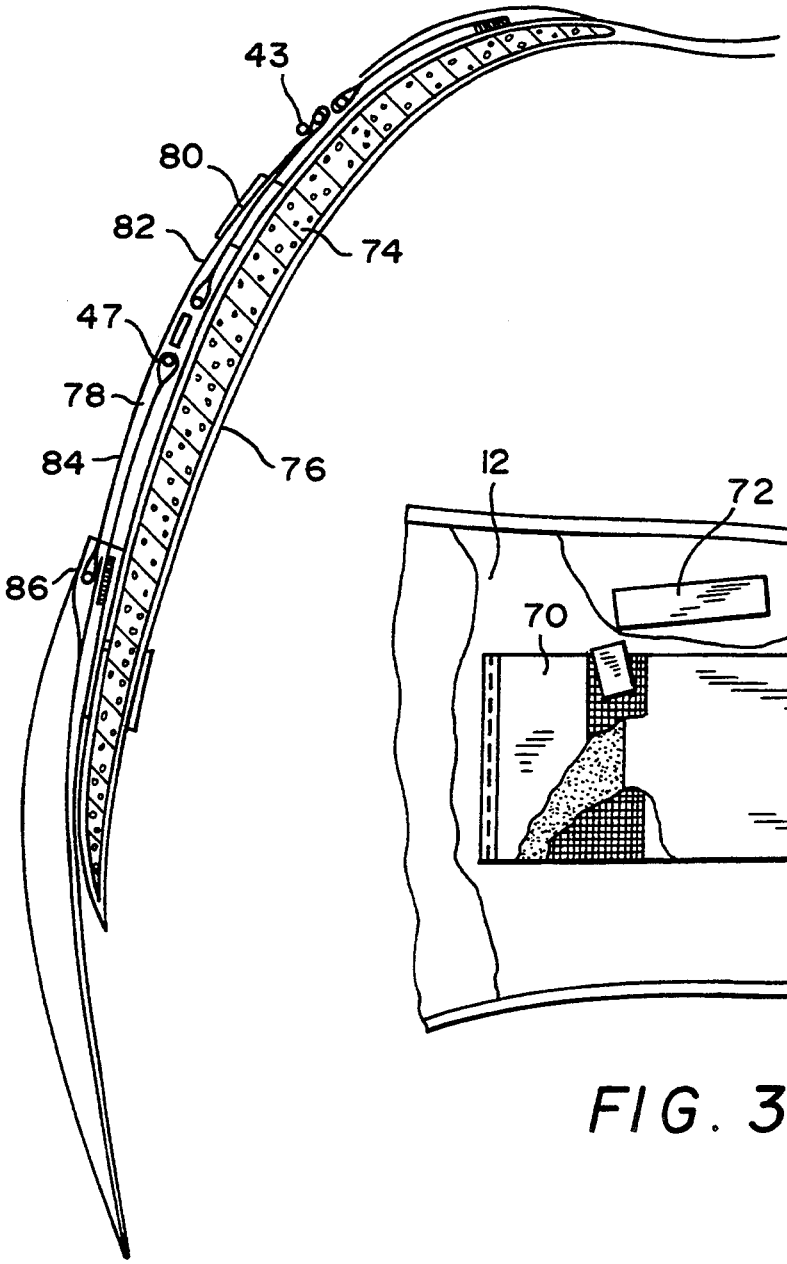
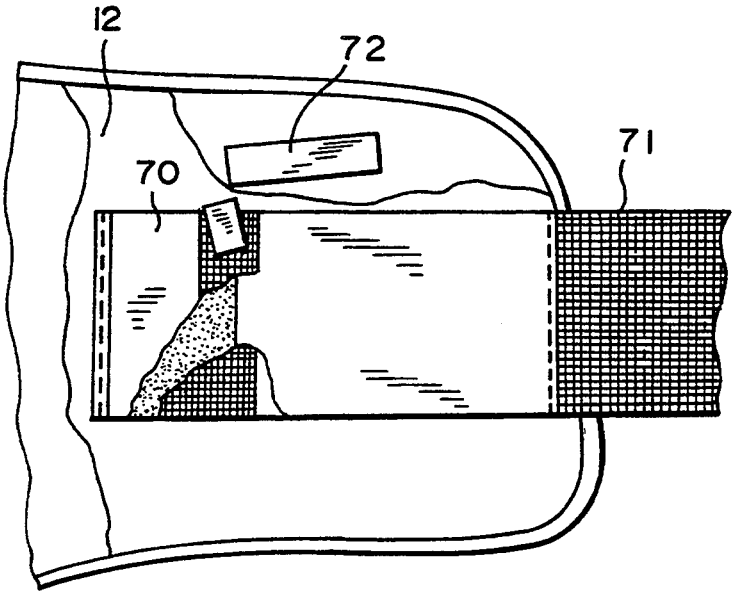
FIG. 3

FIG. 7
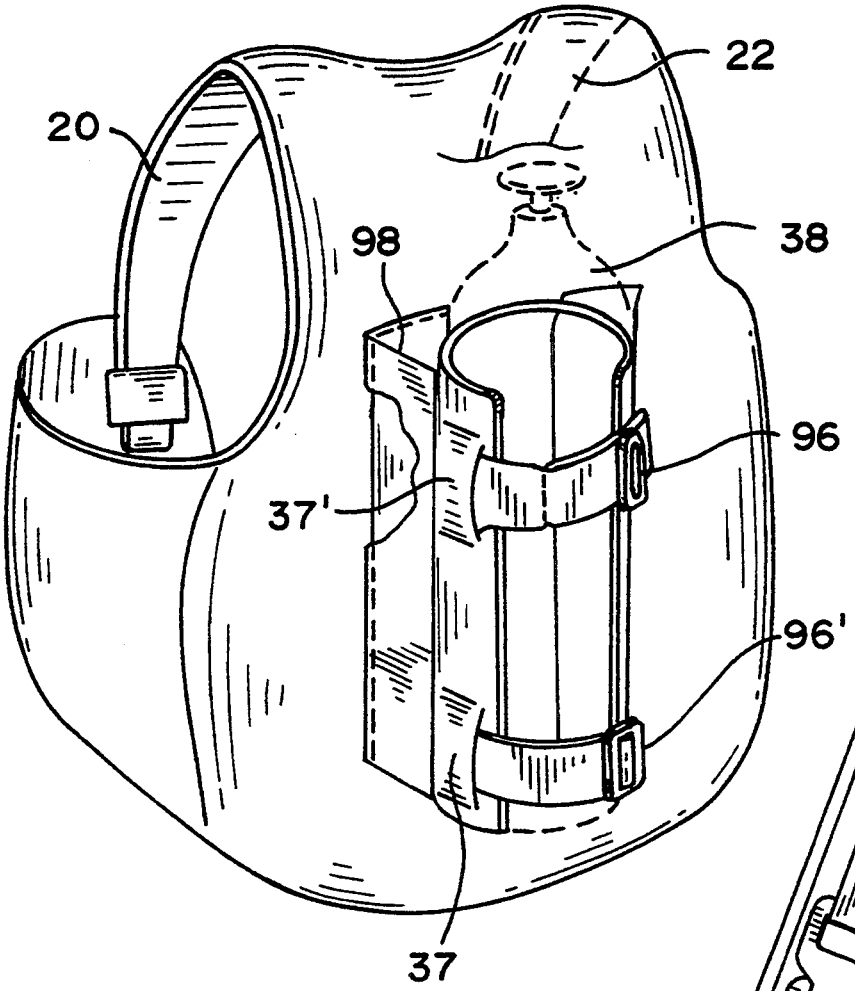
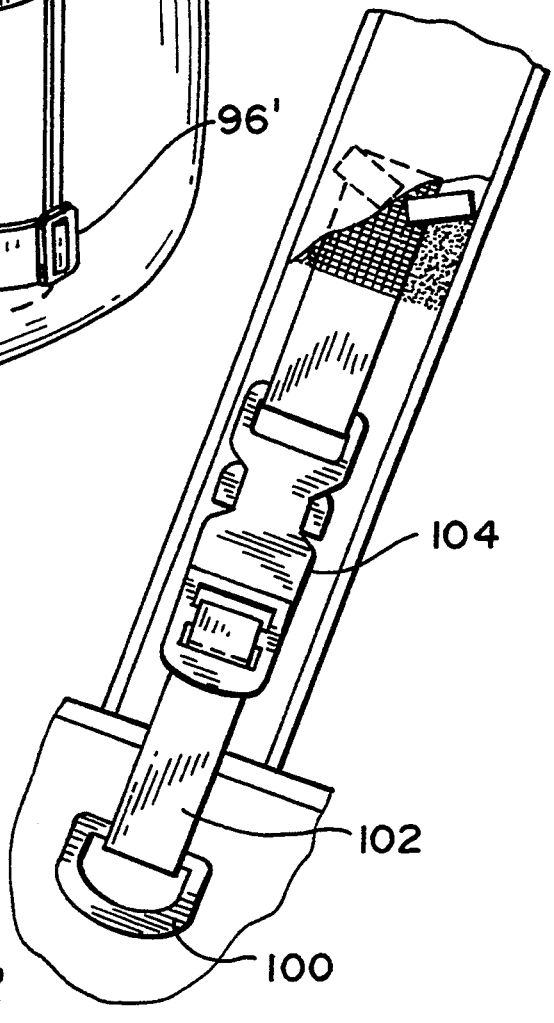
FIG. 8

BACKPACK SYSTEMS

This is a continuation, of application Ser. No. 07/800,442, filed Nov. 18, 1991, which was abandoned upon the filing hereof.

BACKGROUND OF THE INVENTION

This invention relates to backpack systems for carrying loads without the use of a rigid frame structure, and more particularly to improved systems for bearing loads with less fatigue and without restricting the mobility of the user, such as buoyancy compensated jackets for scuba divers.

The problem of increasing the load carrying capacity of a person has been attacked in various ways through recorded history. Depictions carried down from earlier civilizations have shown that very large burdens have been transported by humans, such as through the use of tump lines extending across the forehead for a load carried on the back, and loads suspended on either side of a person from a beam balanced on the shoulders. Where no road system exists, or where loads have had to be transported across arbitrary terrain, as in military operations, many supports have been devised and used. Until about the end of the first half of the twentieth century, these usually comprised a rigid frame with little or no conformity to the back of the user, and a shoulder strap and belt arrangement that was often unpadded. The center of gravity of the load was well out from the back so that the pull on the shoulder straps was often extremely tiring, and the frame itself was often heavy and added substantially to the base weight. These types of packs were supplemented a number of other types, including those known as "Trapper Nelson" and "A frame" packs. These would typically be lighter but otherwise suffered from most of the same deficiencies although they were widely used.

Shortly after the first half of the twentieth century, however, there was increasing growth in recreational backpacking, and a new market opened up for backpacks of a different type. These were usually more costly, but they enabled users to carry a given load with greater comfort, such as the "Kelty" pack introduced by the A. I. Kelty Company. The frame was made of welded aluminum curved to conform closely to the back of the user, and the pack was removably attachable, and positioned in such a way as to shift the center of gravity of the load both higher and more closely spaced to the back of the individual. The back was supported both by a wide waist belt and by adjustable shoulder pad and strap combinations. Thus the downward press of the load thus tended to be exerted more on the hips of a slightly forwardly leaning hiker. This design was followed by a diverse variety of pack frames, with both external and internal pack arrangements, for comfort and convenience.

While a frame is generally needed for the highest capacity loads, there are a number of situations in which the frame restricts movement or occupies too much space. Therefore, soft packs, without frames or supports, are now widely used to carry moderate loads for recreational hiking, for their capability for storage in aircraft overhead compartments, for cross-country skiers, for climbers and others. Here there is a limited amount of conformity with the backpack, but because it is usually supported primarily by the shoulder straps, with limited support from the belt or waistband, the center of gravity of the pack tends to be displaced downwardly and outwardly. This further acts to limit the load carrying capacity and reduce the comfort of the user. In a number of situations, the mobility of the user, and control of backpack position and load movement are of primary importance, such as with the skier and the climber. In both instances, positive control over the load, and maintenance of the sense of balance of the user, without restriction of movement or the imposition of stressful loads, are of greatest importance.

An even more critical example of this type of demanding situation is the backpack for a scuba diver. The pack should support one or two air cylinders, present low resistance to the water as the diver moves, and therefore have a low profile, while not acting to restrict the diving and swimming movements of the user. At the same time, conventional pockets for gear and holders for accessories should be included. Even more, it is desirable to incorporate a "buoyancy compensation" feature. This type of pack has an inflatable bladder or internal chamber, and can be expanded by oral inflation or by using air from the tank. Thus it provides a means for precisely compensating for the diver's weight belt and other equipment at a given depth, so as to minimize the work involved in maintaining a given location. Examples of this type of system are found in the U.S. Pat. Nos. to Greenwood, 3,436,777, Deeds, 4,054,132, Faulconer et al., 4,810,134, Walters, 4,952,095, Walters, 4,016,616, Faulconer et al., 4,561,853, Wright III, 4,137,585, Courtney, 4,779,554, and UK specification No. GB 2197 627A.

Though the earlier systems were bulky, the state of the art has improved considerably, and the present buoyancy compensated (or BC) packs have different combinations of adjustable shoulder straps, flexible or non-stretching waist straps, rigid and semi-rigid tank holders, and different arrangements for the buoyancy compartments and for storage and utility pockets. None have the desirable combination of features that are now sought, including particularly allowing the freedom of motion to the diver, especially when the bladder is inflated. Further they do not provide firm yet non-restraining retention of the tank in a low profile configuration, easy adjustment, and low cost construction. For example, U.S. Pat. Nos. 4,009,583, 4,016,616, 4,137,585 and 4,779,554 all have rigid tank holders and backpacks, while U.S. Pat. No. 4,009,583 also incorporates a semi-rigid air container system with a rigid cover. In U.S. Pat. No. 4,952,095 the backpack is flexible, with an interior liquid, and the container made of a flexible material, while the tank holder is rigid. In this example the waist straps are flexible neoprene, foam rubber, or rigid nylon webbing. In U.S. Pat. No. 4,810,134, the tank holder is rigid, the shoulder straps are non-extendable, and are adjustable only at D-rings or locked buckles. Flexible waistband straps of neoprene foam rubber are utilized, in accordance with U.S. Pat. No. 4,694,772, which describes a buoyancy compensation feature and is said to be automatic. None of these teachings provides a suitable combination of all the features that are desired.

SUMMARY OF THE INVENTION

In accordance with the present invention, a soft backpack that has superior load carrying capabilities comprises a unit including a central panel with shoulder and waist wings or extensions which only partially encompass the body of the user. A front harness system couples the wings together across the front of the body, the front harness system comprising an adjustable wide waistband having off center tensioning segments and shoulder straps coupled to the waist extensions, and also including intermediate tensioning segments and adjustable means. The stretchable portions of the waistband preferably comprise woven fabric webs having webs having neoprene strands in the stretch direction, and polyester and nylon strands in the transverse direction, the width typically being of several inches. This woven construction is permeable to the water, and therefor has little buoyancy, but more importantly has useful tension and stretch characteristics and no tendency to lose stretch upon use. Narrower extensible woven straps are used in the shoulder strap arrangement, and here the tension and stretch are less, because the vertical forces are divided between the two straps.

The adjustable waistband and shoulder straps are positioned such that, even though they have high compliance and firmly hold the load, they do not resist body or limb motion in any significant way. When the jacket is inflated, the user has a freedom of motion that has not been attained heretofore.

Because the tensioned portions of the front harness are interconnected, the load in the pack is maintained with a yielding tension in all directions. The harness distributes the tension, when the links of non-stretchable material are adjusted, so as to hold the pack securely in comfortable position while yielding to body movement in a fully compatible, non-restraining manner. The principal panel of the pack is preferably of two separate layers of closely woven fabric, coated on one or both sides, but coated on at least the interior sides. The layers are joined together along weld or baffle lines to define the internal buoyancy compensation chambers, using R.F. compression or heat techniques. In addition, a tank cradle may be formed in the back of the pack, by spaced apart fabric channels and structural foam inserts may be inserted in the channels on each side of the tank. These supported channels, together with tank straps, are sufficient to hold the tank firmly in position while providing a soft and compactible system.

The jacket for scuba use preferably is constructed around a central double walled panel which is welded to delineate the internal bladder. The shoulder straps have internal padding and both outer and inner panels may be attached to the waist extensions to provide accessible pockets and base means for the waistband.

The extensible portions of the harness are woven fabrics specially designed to satisfy the particular requirements of the application. In a specific example the waistband includes a 4" wide woven web having 30 gauge neoprene strands in the warp direction and nylon strands in the fill direction. This provides the needed "tension" and "stretch" as the term is used in the fabric art, and an anisotropic stretch property since there is stretch only in the longitudinal direction. The shoulder strap segments that are extensible are 1 ½" wide and woven on a 45° bias of neoprene and nylon strands to provide the tension and stretch selected for this portion of the harness. In one form of the invention a flexible sternum strap of about 1" width may be included, above the waistband, to hold the waist wings in close conformity to the body.

In accordance with the invention, buoyancy compensator packs for underwater use are softer and more flexible than prior constructions, and substantial cost savings are effected by the design. Furthermore, the jacket may include a number of pockets which may be interchangeable and in different colors if desired. Further features of the system include an internal detachable clamping arrangement for the waistband, such that the elastic portion can be adjusted to different positions to accommodate different user dimensions, thus enabling economy of construction.

In accordance with the invention, the gas holding bladder in the backpack can be of stretchable or non-stretchable plastic, fabric or rubber. The preferred example, however, is a nylon fabric from 400 to 800 denier coated as described previously. Alternatively, a blend of cordura and nylon from 400–800 denier, can be employed.

The same principles of construction find utility soft backpacks for other purposes. The four-way adjustable harness, and the inter-connected aspects of the harness and central panel, insure that the load will be maintained firmly but compliantly on the body, with the center of gravity being as close as feasible to the upper back shoulders of the user, and moving constantly with the body so that the unitary response is achieved. In other words, the user feels that the load is secure, but not an impediment to movement entirely predictable. The snug fitting characteristic of the backpack need not tend to act to overheat the user, inasmuch as in this adaptation the panel can be a mesh or other air breathing material that provides a little insulative effect.

BRIEF DESCRIPTION OF THE DRAWINGS

A better understanding of the invention may be had by reference to the following description, taken in conjunction with the accompanying drawings, in which:

FIG. 3 is a fragmentary view, partially broken away, of the waistband arrangement in the system of FIGS. 1 and 2;

FIG. 4 is a fragmentary side sectional view of the adjustable shoulder strap arrangement in the system of FIGS. 1 and 2;

FIG. 7 is a perspective view of a second type of tank support arrangement; and FIG. 8 is a fragmentary view of an alternative shoulder strap arrangement.

DETAILED DESCRIPTION OF THE INVENTION

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 5:
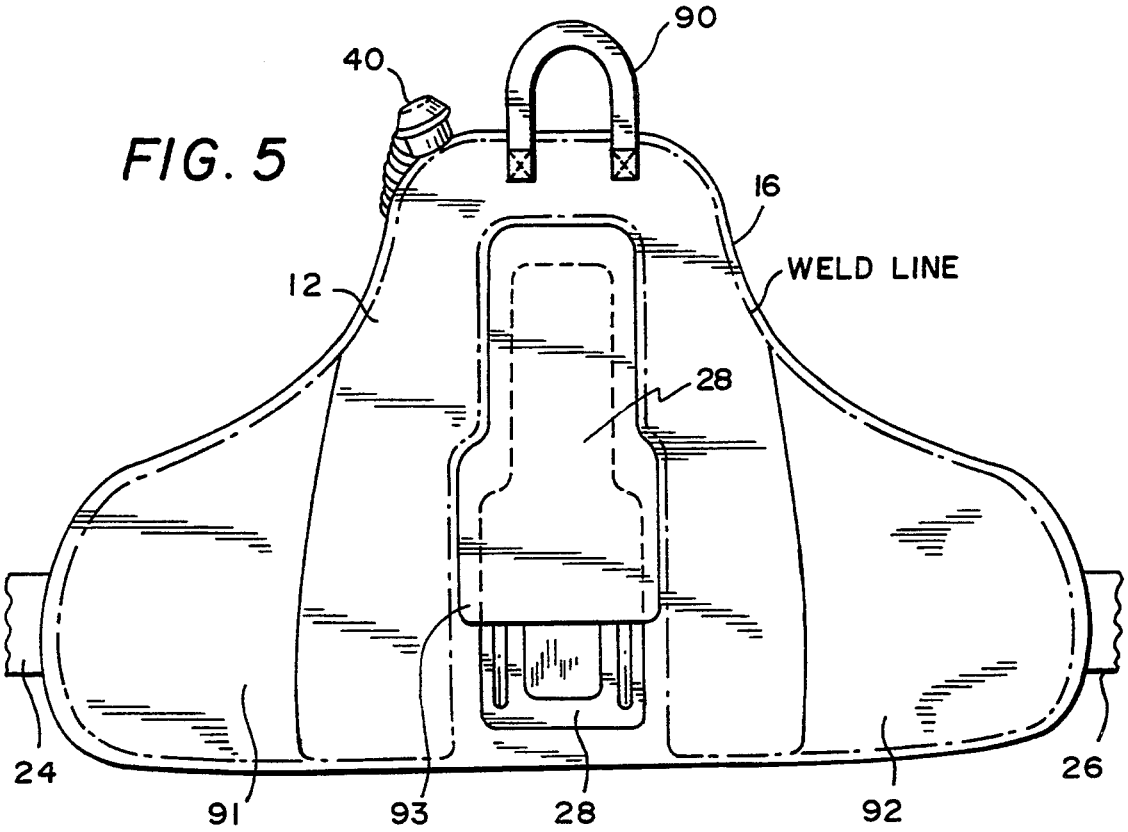
FIG. 5 is a back view of the central panel used in the example of FIGS. 1 and 2.

A backpack in accordance with the invention is shown in FIGS. 1 to 8 that meets the demanding requirements of the scuba diving environment, and comprises a diver's jacket 10 of the buoyancy compensated type. The jacket 10 has a central or principal panel 12 of two layers which are sealed (welded) together along baffle lines 16 as best seen in FIG. 5 to form a fluid retention bladder that may be filled and emptied for buoyancy compensation purposes. In this example, the fabrics used are cordura and nylon cloth of 400–800 denier which have urethane, rubber or neoprene coatings (neoprene being chosen in this example) on both or at least the inner surfaces, both surfaces being coated in this example. Nylon or cordura and nylon fabric 400–800 denier may be employed, and the central panel 12 and may be welded together by conventional means, with radio frequency welding being preferred, although compression and heat welding may also be utilized.

Figure 6:
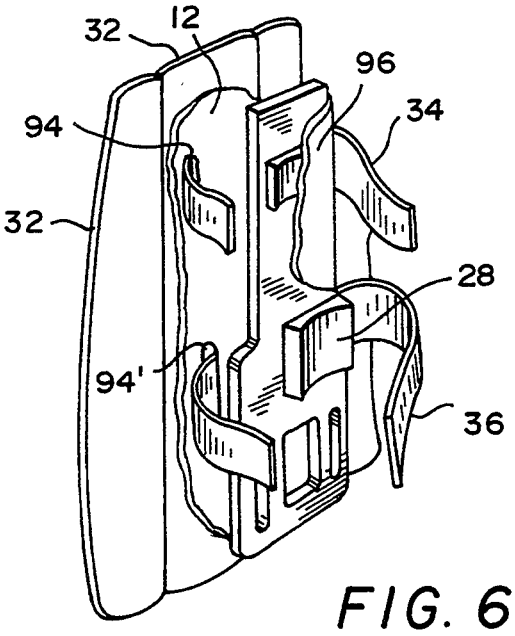
FIG. 6 is a broken away perspective view of a portion of the system showing one tank support arrangement.

The central panel 12 is configured to partially wrap around the diver, having shoulder wings or extensions 20, 22, as best seen in FIG. 7, that extend over the shoulder and down to the waist region of the diver. Additionally, as best depicted in FIG. 5, large waist wings or extensions, 91, 92 extend partially about the side of the diver, being spaced apart at the central front region. At the back of the jacket 10, as seen in FIGS. 5 and 6, a support 28 for the air tank is provided formed in part of a sectional cylindrical panel of engineering plastic such as Delrin, disposed under a fabric cover 30. Tank straps 34 and 36 (FIG. 6), configured concentric with the tank 38 (FIG. 8), extend through slots 94 and 94' in tank support 28. The support 28 being attached to the back pad 32, also called a "plush pad" on the central panel 12, to secure the tank 38 in position. An air feed coupling 40 for coupling to tank 38 and an air release valve 42 are provided on the jacket 10. Inflation hose 39 couples air feed coupling 40 and an air release valve 42 to the tank 38 permitting the bladder to be inflated to a desired internal pressure in a conventional way by using the air tank 38 or a mouth piece (not shown), via the air feed valve 41 that is coupled to the tank 38. In addition, the jacket includes a relief of valve to prevent over inflation of the bladder.

The characteristics of the strap and web materials that are used are imparted by conventional processes, such as weaving a band of given width with elastomeric strands in the warp direction and synthetic polymer strands in the fill direction with selected gauges and densities. The significant properties are that the strap or web stretches longitudinally and not substantially in the transverse direction, that it extends a particular distance in response to a given force, that if not change characteristics after repeated stretching, and that it be of substantially neutral buoyancy. These properties are achieved typically by the use of interwoven neoprene rubber compounds having gauges from 24 to 30, and polyester filaments of 2/150 size and type, in suitable combination of warp ends and elastomeric ends for the chosen width and mechanical characteristics. The nature of the weave can also be varied, as with the 1 ½" straps, which are on a 45° bias.

In the fabric industry, the characteristics of narrow fabrics are given in terms of "tension" defined in a particular way. Bench marks are placed 10" apart on a 16" specimen which is clamped at one end and has a test weight (here 15 lbs.) attached to the other end. The test weight is lowered gradually until supported by the fabric, and this is repeated three times, after which the weight is allowed to hang free and the distance between the bench mark is measured. The tension, in percent, is then given by:

$$\frac{\text{(Measured Distance)} - \text{(Nominal Bench Mark Distance)}}{\text{(Nominal Bench Mark Distance)}} \times 100$$

If, in other words, the distance between bench marks increases by 2 inches, the tension is 20%. Given this parameter, the different narrow fabrics used here have the following practical values for a scuba jacket, assuming a single air tank load:

| | |
|---|---|
| 1" | 75% tension |
| 1½" | 52% tension |
| 4" | 30% tension |

Given these values for the stated application, it will be appreciated that different values may also be used without substantially affecting the mobility of the user. For different fabrics a range of ±30% has been found adequate for tension values. However, the entire scale is shifted to higher tensions if the load mass is substantially increased, and to a lower range if the load mass is less.

Because of the placement of the extendable segments, and their intercoupling, they represent minor forces on the body even though they contribute in cooperative manner to distributing the load of the pack. The vertical forces relative to the height of the body exerted by the load act to tension the waist, thus distributing the load without stressing any particular body area.

Figure 1:
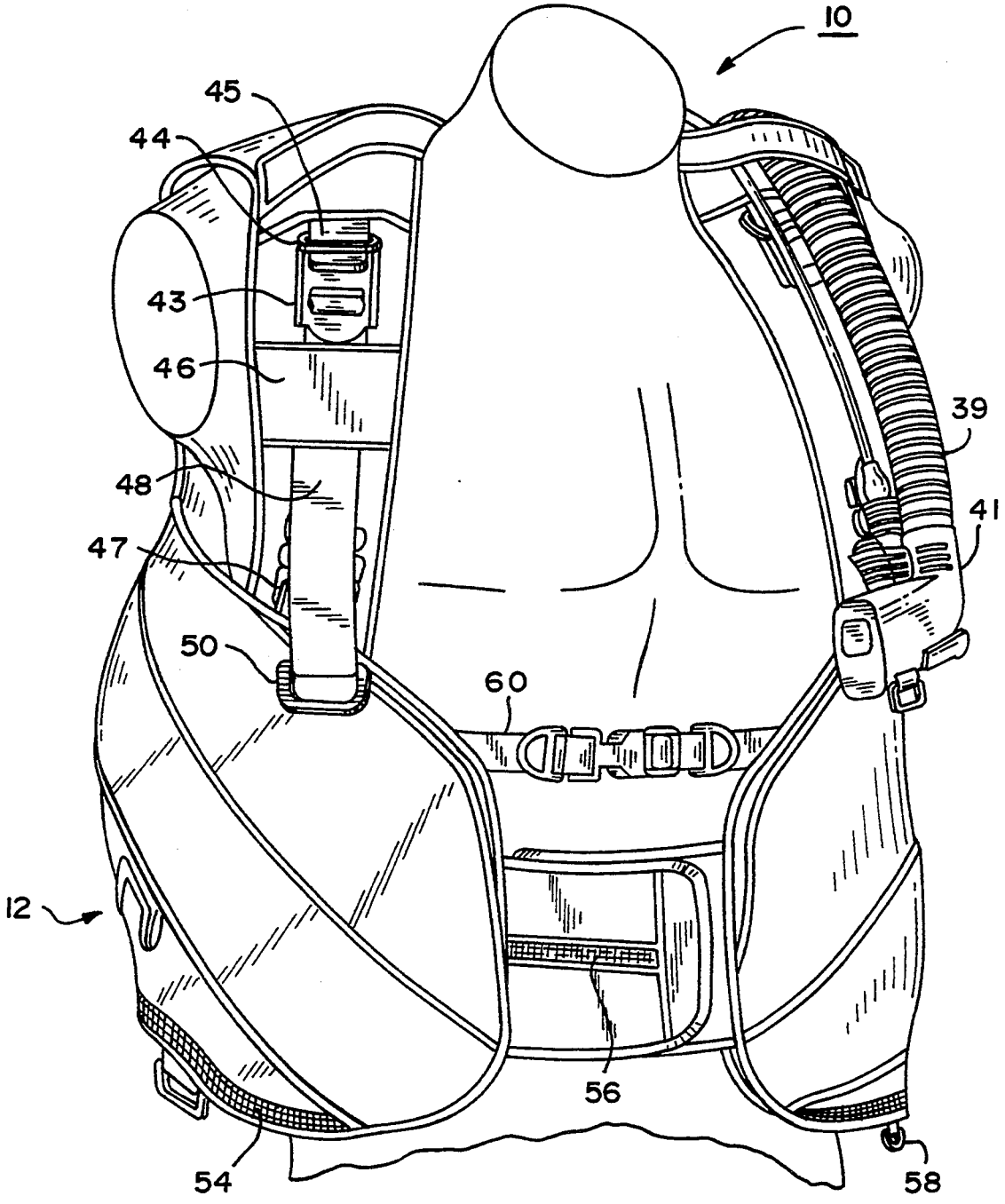
FIG. 1 is a perspective view of a first form of buoyancy compensated jacket in accordance with the invention.

As best seen in FIG. 1, an upper strap coupling 43 having a loop 44 is used to feed a nonstretchable strap 45 through the loop 44 and coupling 43 securing it to the jacket 10. Lateral loop 46 covers lower strap 48 maintaining tension against the strap so that the jacket 10 is kept taut and streamlined against the diver's body. Longitudinal, flexible or "extensible" strap 48 is a section having a first end which is attached and adjustable in relation to upper coupling 43. Strap 48 is typically 1 ½" wide and may be weaved at a 45° bias, but those skilled in the art will readily recognize that other widths and weaves can be advantageous dependent upon the size of the jacket. A second end of the longitudinal strap 48 is attached to a ring 50. Ring 50 may be tucked into a small pocket (not shown) formed in jacket 10 for streamlining.

Lower coupling 47 comprises detachable mating male and female components. The lower component (male or female) is attached to a non-stretchable strap secured inside the waist wing while the upper component is attached to the central panel 12.

Vent 54 is made of a mesh-like or porous material allowing drainage from the jacket 10. Zipper 56 provides an opening to a small front pocket in the waistband. Auxiliary ring 58 may be used for attachment of miscellaneous accessories used in the sport such as, but not limited to, skin diving.

The jacket 10 being symmetrical is constructed in a similar manner on the opposite shoulder side. That is, elements 43–50 operate and are constructed in an identical fashion.

A sternum strap 60 made of a flexible material is attached to the jacket 10 and is concentric to the diver's waist. The strap 60 keeps the top of the waistband from flaring open.

Figure 2:
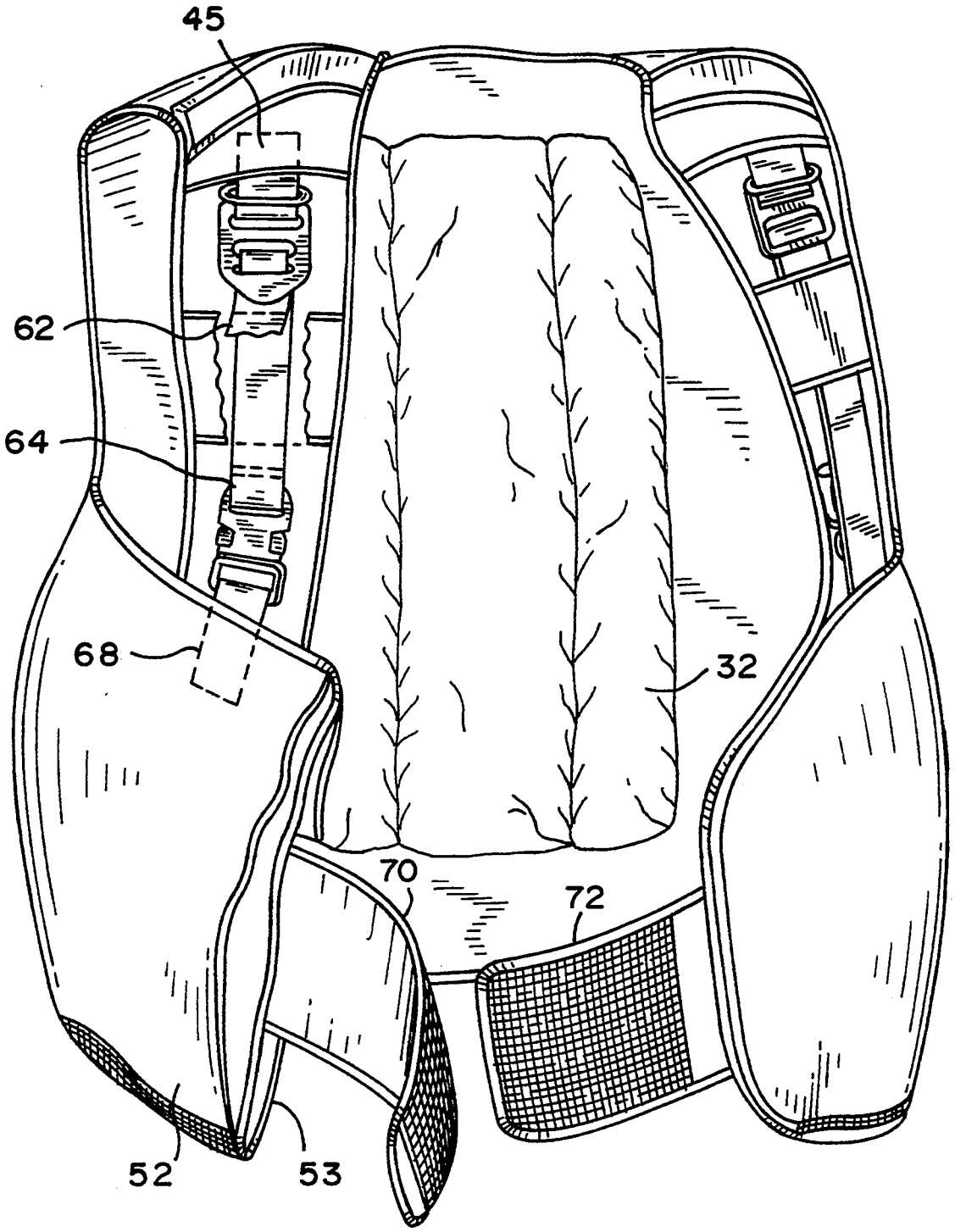
FIG. 2 is a perspective view, partially broken away, showing different aspects of the example of FIG. 1.

Now referring to FIG. 2, a better view of the plush pad 32 is depicted. Non-stretchable strap 45 is depicted sewn into the left upper corner of the jacket 10. A loose end 62 of the non-stretchable strap 45 is depicted to show the detail of the weaving through upper strap coupling 43. A strap is depicted having a first end attached to upper strap coupling 43 and a second end in a fixed loop 64 attached to the lower strap coupling 47. As previously mentioned, lower strap coupling 47 is comprised of detachable male and female elements. The first element of lower strap coupling 47 is attached to a loop in the strap. The second element of coupling 47 is fixed to the outer layer by being sewn to it or can be attached using velcro attachment.

A waistband having a first end 70 and a second end 71 have on its surface complimentary velcro hook and loop to provide adjustability of the jacket 10 circumference. When the waistband 70, 71 is unhooked so to speak, there is longitudinal stretch so as to provide flexibility within the jacket.

As best seen in FIG. 2, adjustable wide waistbelt has a first end 70 and second end 72 fitted between outer and inner layers 52 and 53 respectively. Referring now to FIG. 3, a more detailed view of the waistband arrangement is depicted. The first end 70 of the waistband is sewn to the central panel of jacket 10. Similarly, the second end 72 of the waistband is sewn to the central panel inside the layers of one of the wings. Either surface of the first or second end of the waistband may have the hook or loop material. The waistband may be made of double layered or flapped with velcro attachments on each of the individual layers to insure a tight fit. The waistband preferably comprises woven fabric webs having webs having neoprene strands in the stretch direction, and polyester and nylon strands in the transverse direction, the width typically being of several inches. This woven construction is permeable to the water, and therefor has little buoyancy, but more importantly has useful tension and stretch characteristics and no tendency to lose stretch upon use. A gator clamp 72 is provided for allowing adjustment of the waist band. In the preferred embodiment, the waistband has a longitudinal width of approximately four inches, but those skilled in the art will readily recognize that other widths may be more suitable for different sized jackets.

Referring now to FIG. 4, a side sectional fragmentary view of the adjustable shoulder strap is illustrated. The shoulder strap is attached to the central panel at both top and bottom ends. A foam padding 74 is layered between an inner fabric 76 and an outer fabric 78. The upper coupling 43 is illustrated attached to the outer fabric 78 at the top end of the adjustable strap and includes a loop 80 for streamlining the strapping proces. The lower detachable male and female coupling 47 is illustrated attached also to the outer fabric 78. Stretchable material 82 spans between the loop 80 for holding the strap and the male and female coupling 47. A span of non-stretchable strap 84 spans between the coupling 47 and a pocket 86 for tucking in the loose end of the stretch strap. The pocket 86 is sewn to the outer fabric 78.

Referring now to FIG. 5, the back view of the central panel is depicted to illustrate more detail. A hanger loop 90 is provided to hang the jacket 10 for drying or storage purposes. Two layers of the center panel are sealed together at back lines 16 so that the entire panel may be blown up to provide balance buoyancy.

As earlier mentioned, air tank or manual inflation may be maintained. Valve 40 may be manually blown up from the mouth or from the tank and has a relief valve 41 (FIG. 1) for over pressure.

Waist wings or extensions 91 and 92 are sewn to the to the center panel although they may be attached by velcro so as to be interchangeable. The interchangeability allows different color schemes to be attached to the jacket and to identify divers such as master or a novice diver. The fabric cover is sewn to the central panel around the edge at 93.

Tank holder 28 is also shown in fragmentary form but does not include the cylindrical portion (shown in FIG. 6) matching the circumference of the tank 34. The tank holder 28 is approximately one-inch thick and is made of delrin, a type of plastic, but those skilled in the art will readily recognize that other materials and thicknesses may be used to hold the tank.

Referring now to FIG. 6, slots 94 and 94′ allow tank straps 34 and 36 to secure the tank to the plush pad 32. The straps are sewn to the plush pad 32 and fit through slots 94 and 94′. A fabric cover 96 may be used to cover the rigid tank holder. Plush pad (back pad) 32 rests against the diver's back and tank straps 34 and 36 may have hinge coupling clamps for quick release of the tank.

Reference is now made to FIG. 7 which depicts a second type of tank support arrangement. This is the preferred form of tank holder because the unit is completely soft and provides comfortability to the diver. Large hinges 96 and 96′ may be used for quick release of the tank in conjunction with straps and slots 37 and 37′. Structural foam 98 is inserted behind the air tank 38 and between the jacket and is removable and is ma be covered by fabric for protection.

Referring now to FIG. 8 a fragmentary view of an alternative shoulder strap arrangement is depicted. A non-stretchable strap 102 is looped through an attachment ring 100 to a detachable male and female type coupler 104 on a first end. The detachable coupler 104 second end is attached to a stretchable strap which is adjustable and is secured by velcro on both sides with the use of small tabs to help secure the strap.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A pack unit for enabling a user to carry a substantial back supported load with comfort and mobility, comprising:

(a) a flexible load container having a base panel for engagement on the back of a user, the base panel having integral shoulder extensions fitting over each shoulder, and integral waist extensions fitting around a portion of the waist of the user; and (b) harness means having a number of elements, disposed on the front of the user, the harness means including waist belt segments for adjustably interconnecting the waist extensions of the flexible load container across the front of the waist of the user, and shoulder segments for adjustably interconnecting the shoulder extensions to the waist extensions, at least the waist belt segments of the harness means each being longitudinally flexible within a selected range, such that load forces are transmitted to the load container at the waist of the user while holding the load in conformity to the user without restricting body movement.

2. A pack unit as set forth in claim 1 above, wherein the shoulder segments comprise webbing having a tension in the range of 37% to 67%, and the waist belt segments comprise woven fabric webs of a tension in the range of 20% to 40%.

3. A pack unit as set forth in claim 1 above, wherein the waist extensions comprise terminal non-extensible portions having complementary hook and loop surfaces for adjustable length but separable coupling and tension relative to the waist of the user.

4. A pack unit as set forth in claim 1 above, wherein the flexible load container and the harness means together comprise a buoyancy compensated scuba jacket having internal bladder pressurized with a mass compensating gas, and wherein the waist belt segments include means for adjustable attachment to the waist extensions and comprise wide bands of stretch fabric and wherein the shoulder segments are attached to the waist extensions and shoulder extensions respectively and include means for adjusting the length thereof.

5. A pack unit as set forth in claim 4 above, further comprising cradle means for receiving an air supply tank on the opposite side of the pack from the user, the cradle means compromising a pair of spaced apart channels vertically disposed on the posterior side of the pack unit, removable structural elements within the channels, and strap means for securing the tank in position between the channels.

6. A pack unit as set forth in claim 5 above, wherein the flexible load container comprises a double layer fabric structure, the layers comprising 400 to 800 denier cloth having weldable layers at least on the interior surface thereof and including sealed portions defining the internal bladder, and wherein the waist belt segments includes terminal portion hook and loop fastener means for coupling together.

7. A soft backpack, comprising:

(a) a fabric pack unit for carrying loads on the back of a user, the pack unit having shoulder wings extending over the users shoulders and waist wings extending partially about the front of the user's waist, and (b) harness means, positioned on the front of the user, for intercoupling the shoulder wings to the waist wings and the waist wings to each other, the harness means comprising a pair of shoulder straps, each having a base element coupled to a different shoulder wing and extending toward the waist of the user, and a terminal, adjustable, non-extensible element coupled to adjacent waist wing; and a pair of waistbands each having an extensible fabric web portion coupled to a different waist wing, and a terminal non-extensible portion, the terminal non-extensible portions of the waistbands being coupled together in an adjustable relation.

8. A soft backpack as set forth in claim 7 above, wherein the shoulder straps include extensible elements comprising webbing having a tension in the range of 37% to 67%, and the extensible web portions of the waistbands comprise woven fabric webs of a tension in the range of 20% to 40%.

9. A soft backpack as set forth in claim 7 above, wherein the waistband segments comprise terminal non-extensible portions having complementary hook and loop surfaces for adjustable length but separable coupling.

10. A soft backpack as set forth in claim 7 above, wherein the pack unit comprises a buoyancy compensated scuba jacket having internal bladder means to be pressurized with a mass compensating gas.

11. A soft backpack as set forth in claim 10 above, wherein the pack unit further comprises cradle means on the opposite side from the user for receiving an air supply tank, the cradle means comprising a pair of spaced apart channels vertically disposed on the posterior side of the pack unit, removable structural elements within the channels, and strap means for securing the tank in position between the channels.

12. A soft backpack as set forth in claim 11 above, wherein the pack unit comprises a double layer fabric structure, the layers comprising 400 to 800 denier cloth having weldable layers at least on the interior surface thereof and including sealed portions defining the internal bladder, and wherein the waist wings include pockets for receiving the waistband segments therein, the waist wings and waist band segments including mating loop and hook segments for adjustable attachment.

13. A buoyancy compensated jacket for scuba divers, comprising:

(a) a central, double walled fabric panel having shoulder extensions for fitting over the shoulders of a user and side extensions in the waist region for fitting partially around the waist of the user, the fabric being of 400–800 denier and having polymeric coating thereon on at least the inner surfaces thereof, the shoulder extensions being double layered and extending to below the upper edge of the respective side extensions;

(b) padding disposed between the layers of the shoulder extensions;

(c) weld means for providing baffle lines in a geometrical pattern on the central panel to define an interior bladder on both sides of a central mounting region and through a substantial portion of the side extensions;

(d) means mounted on the central panel for providing access to the interior bladder for introducing a fluid therein for buoyancy compensation;

(e) a back pad on the interior side of the central mounting region for engagement with the diver's back;

(f) rigid member means mounted on the exterior side of the central mounting region and including a cover panel therefor;

(g) strap means coupled through central panel in the central mounting region to the back pad, for retaining an air tank against the rigid member means;

(h) a pair of shoulder strap means, each coupled at an upper end to a different one of the shoulder extensions, each shoulder strap means comprising an upper rigid strap segment, an intermediate longitudinally stretchable strap segment and a lower rigid strap segment, the upper segment being coupled to the shoulder extension in the upper shoulder region of the diver and the lower segment being coupled to the upper portion of the more proximate side extension of the shoulder strap means also including an upper coupler coupling the lower end of the upper segment to the upper end of the intermediate segment; and a male-female coupler coupling the lower end of the intermediate segment to the upper end of the lower segment, the intermediate segment being looped through the upper coupler, and having a loose anterior end and a closed loop about the male-female coupler; the lower segment being coupled to the male-female coupler, the stretchable segment of the shoulder strap means having a tension in the range of 52% ±30%; and (i) a pair of waistband means, each coupled to a different one of the side extensions and extending across the center waist portion of the diver, the waistband means each including a longitudinally stretchable web having a tension in the range of 30% ±30%, the waistband means each including a surface portion of complementary hook and loop material adjacent the free ends thereof for adjustable coupling of the webs together, and means for adjustably securing the waistband means to the side extensions.

* * * * *